US011139584B2

(12) United States Patent
Giusto

(10) Patent No.: US 11,139,584 B2
(45) Date of Patent: Oct. 5, 2021

(54) ANTENNA FEEDER ASSEMBLY OF MULTI-BAND ANTENNA AND MULTI-BAND ANTENNA

(71) Applicant: HUAWEI TECHNOLOGIES CO., LTD., Guangdong (CN)

(72) Inventor: Roberto Giusto, Segrate (IT)

(73) Assignee: Huawei Technologies Co., Ltd., Shenzhen (CN)

( * ) Notice: Subject to any disclaimer, the term of this patent is extended or adjusted under 35 U.S.C. 154(b) by 2 days.

(21) Appl. No.: 16/709,417

(22) Filed: Dec. 10, 2019

(65) Prior Publication Data

US 2020/0185835 A1 Jun. 11, 2020

Related U.S. Application Data

(63) Continuation of application No. PCT/EP2017/066336, filed on Jun. 30, 2017.

(51) Int. Cl.

| | |
|---|---|
| ***H01Q 13/00*** | (2006.01) |
| ***H01Q 21/00*** | (2006.01) |
| ***H01Q 15/14*** | (2006.01) |
| ***H01Q 21/30*** | (2006.01) |

(52) U.S. Cl.
CPC ..... *H01Q 21/0006* (2013.01); *H01Q 15/14* (2013.01); *H01Q 21/30* (2013.01)

(58) Field of Classification Search
CPC .... H01Q 21/0006; H01Q 15/14; H01Q 21/30; H01Q 5/47; H01Q 13/24
USPC ..... 343/781
See application file for complete search history.

(56) References Cited

U.S. PATENT DOCUMENTS

| | | | | |
|---|---|---|---|---|
| 3,732,571 A | | 5/1973 | Neale | |
| 4,148,035 A | | 4/1979 | Foldes | |
| 4,258,366 A | | 3/1981 | Frosch | |
| 4,518,968 A | * | 5/1985 | Hately | H01Q 9/16 343/802 |

(Continued)

FOREIGN PATENT DOCUMENTS

| | | |
|---|---|---|
| CN | 101192714 A | 6/2008 |
| CN | 101785141 A | 7/2010 |

(Continued)

OTHER PUBLICATIONS

MIWV, "268 Series scalar feed horns", Jun. 28, 2013. 1 page.

(Continued)

*Primary Examiner* — Jean B Jeanglaude
(74) *Attorney, Agent, or Firm* — Fish & Richardson P.C.

(57) ABSTRACT

The present disclosure provides an antenna feeder assembly of a multi-band antenna, comprising a first feeder supporting propagation of waves in a first frequency band and a second feeder supporting propagation of waves in a second frequency band lower than the first frequency band. The second feeder coaxially surrounds the first feeder. The first feeder comprises a dielectric emitting section and a dielectric radiating section; wherein each of the dielectric emitting section and the radiating section includes an inner cavity, a wall, and sub-wavelength elements on an external surface of the wall. The present disclosure also provides a multi-band microwave antenna, comprising a dish reflector, a subreflector, and the above-mentioned antenna feeder assembly.

16 Claims, 8 Drawing Sheets

(56) References Cited

U.S. PATENT DOCUMENTS

| | | | | |
|---|---|---|---|---|
| H584 | H | 2/1989 | Schwering et al. | |
| 6,369,774 | B1 * | 4/2002 | Lucidarme | H01Q 1/246 343/872 |
| 6,369,776 | B1 * | 4/2002 | Leisten | H01Q 11/08 343/895 |
| 7,088,290 | B2 * | 8/2006 | Ohno | H01Q 1/1221 343/700 MS |
| 7,091,921 | B2 * | 8/2006 | Ohno | H01Q 13/20 343/771 |
| 7,408,515 | B2 * | 8/2008 | Leisten | H01Q 9/42 343/702 |
| 7,903,044 | B2 * | 3/2011 | Leisten | H01Q 1/243 343/895 |
| 8,354,970 | B2 | 1/2013 | Armbrecht et al. | |
| 10,436,931 | B2 * | 10/2019 | Pan | G01V 3/30 |
| 2002/0030632 | A1 | 3/2002 | Popa et al. | |
| 2005/0009566 | A1 * | 1/2005 | Kaegebein | H01Q 13/203 455/562.1 |
| 2005/0140556 | A1 * | 6/2005 | Ohno | H01Q 13/28 343/770 |
| 2008/0174504 | A1 | 7/2008 | Tuau et al. | |
| 2009/0021442 | A1 | 1/2009 | Syed et al. | |
| 2009/0167630 | A1 * | 7/2009 | Leisten | H01Q 11/08 343/895 |
| 2010/0295745 | A1 | 11/2010 | Armbrecht et al. | |
| 2013/0271348 | A1 | 10/2013 | Syed et al. | |
| 2013/0271349 | A1 | 10/2013 | Wright et al. | |
| 2015/0097747 | A1 | 4/2015 | Hwang et al. | |
| 2015/0192669 | A1 | 7/2015 | Shylo et al. | |
| 2017/0307776 | A1 * | 10/2017 | Pan | G01V 3/30 |
| 2019/0229427 | A1 * | 7/2019 | Haziza | H01Q 21/0043 |

FOREIGN PATENT DOCUMENTS

| | | | |
|---|---|---|---|
| CN | 101944658 | A | 1/2011 |
| CN | 103339797 | A | 10/2013 |
| CN | 104205497 | A | 12/2014 |
| TW | 494605 | B | 7/2002 |

OTHER PUBLICATIONS

Milligan, Chapter 7 : HORNS—Modern Antenna Design, Second Edition, John Wiley and Sons, Inc. 2005, 43 pages.

Britton et al., "Corrugated Silicon Platelet Feed Horn Array for CMB Polarimetry at 150 GHz," Jul. 6, 2010, 12 pages.

Dubrovka F. F et al., "A Dualband Coaxial Dielectric-Loaded Feed Horn," International Conference on Antenna Theory and Techniques, Sevastopol, Ukraine, Sep. 17-21, 2007, 2 pages.

Dousset et al., "A Compact High-Performance Orthomode Transducer for the Atacama Large Millimeter Array (ALMA) Band 1 (31 45 GHz)," vol. 1, Jul. 18, 2013, 8 pages.

Navarrini et al., "A Turnstile Junction Waveguide Orthomode Transducer," IEEE Transactions on Microwave Theory and Techniques, vol. 54, No. 1, Jan. 2006, 6 pages.

San BIas et al., "Full-Wave Analysis and Design of Broadband Turnstile Junctions," Progress in Electromagnetics Research Letters, vol. 24, 149-158, 2011, 10 pages.

Popov et al., "Amplitude Aperture-Distribution Control in Displaced-Axis Two-Reflector Antennas," IEEE Antennas and Propagation Magazine, vol. 39, No. 6, Dec. 1997, 6 pages.

Targonski, "A Multiband Antenna for Satellite Communications on the Move" IEEE Transactions on Antennas and Propagation, vol. 54, No. 10, Oct. 2006, 7 pages.

Lee, "The Development, Variations, and Applications ofan EHF Dual-Band Feed", vol. 4, No. Jan. 1991, The Lincoln Laboratory Journal, 20 pages.

Dubrovka F. F et al., "Recent Progress in Development of Multiband Feed Horns (Review)," International Conference on Antenna Theory and Techniques, Sevastopol, Ukraine, Sep. 17-21, 2007, 6 pages.

Yamauchi et al., "Numerical Analysis of a Cigar Antenna," 2011, 4 pages.

ETSI EN 302 217-4-2 V1.5.1 (Jan. 2010), Fixed Radio Systems; Characteristics and requirements for point-to-point equipment and antennas; Part 4-2: Antennas; Harmonized EN covering the essential requirements of article 3.2 of the RandTTE Directive, Jan. 2010, 35 pages.

Chung et al., "Two-Layer Dielectric Rod Antenna," IEEE Transactions on Antennas and Propagation, vol. 56, No. 6, Jun. 2008, 5 pages.

Hanham et al., "Evolved-Profile Dielectric Rod Antennas" IEEE Transactions on Antennas and Propagation, vol. 59, No. 4, Apr. 2011, 10 pages.

Liu et al., "New Method for Ultra Wide Band and High Gain Rectangular Dielectric Rod Antenna Design," Progress in Electromagnetics Research C, vol. 36, 131-143, 2013, 13 pages.

Ando et al., "Linearly and Curvilinearly Tapered Cylindrical-Dielectric-Rod Antennas," IEEE Transactions on Antennas and Propagation, vol. 53, No. 9, Sep. 2005, 7 pages.

Richter et al., "Mean and Differential Phase Centers of Rectangular Dielectric Rod Antennas," 34 European Microwave Conference—Amsterdam, 2004, 7 pages.

Chang et al., "NMT X/Ka Tri-Band Antennas," IEEE, 2013, 4 pages.

Granet et al., "Optimization of Compact SATCOM Terminals" Published in: 2012 Military Communications and Information Systems Conference (MilCIS), 5 pages.

Strube et al., "High-Efficiency Satellite Antenna, Electronics Letters" vol. 19 No. 8, Apr. 4, 1983, 3 pages.

Holler et al., "Implementation of an Optimised Cassegrain System for Radio Telescopes" Mon. Not. R. Astron. Soc. 000, 1-4 (2007) , Dec. 6, 2007, 4 pages.

Holler et al., "A Circularly Symmetric Antenna Design With High Polarization Purity and Low Spillover" IEEE Transactions on Antennas and Propagation, vol. 61, No. 1, Jan. 2013, 8 pages.

Doktor-Ingenieur et al., "Dielectric Tubular Endfire Antennas for Industrial Radar Level Measurements: Analysis and Design" 2011, 246 pages.

Office Action issued in Chinese Application No. 201780049370.6 dated Aug. 2, 2019, 18 pages (With English Translation).

PCT International Search Report and Written Opinion in International Application No. PCT/EP2017/066,336, dated Mar. 16, 2018, 14 pages.

* cited by examiner

ANTENNA FEEDER ASSEMBLY OF MULTI-BAND ANTENNA AND MULTI-BAND ANTENNA

CROSS-REFERENCE TO RELATED APPLICATIONS

This application is a continuation of International Application No. PCT/EP2017/066336, filed on Jun. 30, 2017, the disclosure of which is hereby incorporated by reference in its entirety.

TECHNICAL FIELD

The present invention relates to an antenna feeder assembly and a multi-band antenna. The feeder assembly and antenna package are particularly designed for microwave band and millimeter-wave band.

BACKGROUND

Multi-Band Microwave Antennas based on the parabolic dish have a long track record, as the most important advances in this field are relevant to Space Communications and VSAT applications, where restrictions of mass and size led to the design and integration of very high performance microwave and millimeter-wave components.

Usually, the manufacturing cost of such products and components is not a critical issue for Space Communication applications. Moreover, the standard technical requirements for space communication applications are less stringent than the Terrestrial Communication ones, where broadband performances are more difficult to achieve for low cost Multi-Band Antenna products with professional grade and high reliability currently applicable for Microwave Backhaul (according to ETSI EN 302 standards).

For these reasons, traditional Terrestrial Radio-Links make use of two or even more dish antennas for separate transmission of microwave bands and millimeter-wave bands, posing high requirements for tower construction, installation and cost.

Nowadays, the expansion of Terrestrial Wireless Networks requires careful management and optimization of the scarce tower resources, especially in urban environments where the density of point-to-point radio-links is higher. This is a great motivation for reducing antenna deployment difficulties, tower space and wind-load, tower investments and lease fees.

The design-to-cost of this multi-band feeder antenna is a challenging task, because the high performance and flexibility requirements should be achieved at the same time together with tightest standard requirements ETSI EN 302 217 relevant to terrestrial microwave backhaul and millimeter-wave radio-links.

Therefore there is the need of a Multi-Band Antenna, which can be produced at low-cost and which has a compact design.

SUMMARY

In view of the above-mentioned problems and disadvantages, the present invention aims at improving the conventional approaches for. The present invention has the object to provide a multi-band feeder assembly and a multi-band antenna with stable phase center.

The proposed invention provides a Multi-Band Antenna made of a single parabolic dish reflector with very high gain, which can transmit and receive several independent wireless signals on different wide bands.

For example the performance of the antenna according to the present invention is in compliance with ETSI EN 302 by using radiators working at different bands in the frequency range starting from several GHz up to hundreds of GHz.

The present invention is based on the observation that, the phase center, i.e. the point from which the electromagnetic radiation spreads spherically outward is very sensitive to the frequency band at which the antenna works. In particular, the position of the phase center of traditional antenna moves continuously towards the open end portion of the antenna with increasing frequency. Such behaviour deteriorates the efficiency, the peak Gain and the sidelobe pattern performance of the antenna. In particular, if the antenna is set to have optimal performance within a specific frequency band, the performance of the antenna within a higher frequency band will deteriorate due to the displacement of the phase center. Therefore, a stable phase center is important for a single dish multi-band antenna.

The object of the present invention is achieved by the solution provided in the enclosed independent claims. Advantageous implementations of the present invention are further defined in the dependent claims. In particular the present invention proposes a sub-wavelength element.

A first aspect of the present invention provides an antenna feeder assembly of a multi-band antenna, comprising a first feeder supporting propagation of waves in a first frequency band and a second feeder supporting propagation of waves in a second frequency band lower than the first frequency band, wherein the second feeder coaxially surrounds the first feeder; and the first feeder comprises a dielectric emitting section, a dielectric radiating section and an inner cavity. The dielectric emitting section includes a wall, and sub-wavelength elements on an external surface of the wall or in the wall. The sub-wavelength elements are arranged along the longitudinal direction of the first feeder and each sub-wavelength element has a dielectric constant different than the dielectric constant of the dielectric emitting section.

The sub-wavelength elements enable a stable phase center, which result in wide band antenna operation with constant performance, e.g. in terms of antenna efficiency, peak gain and sidelobe pattern.

According to a further implementation of the antenna feeder assembly according to the first aspect of the present invention, at least one dimension of the sub-wavelength element is not greater than one fourth of wavelength of the wave in the first frequency band.

According to a further implementation of the antenna feeder assembly according to the first aspect of the present invention, the sub-wavelength element includes: a hole piercing the wall in the radial direction, and/or a thread or groove extending in a circumferential direction around the axis of the first feeder. The sub-wavelength element may also include a teeth and grooves alternation extending in a circumferential direction around the axis of the first feeder.

According to a further implementation of the antenna feeder assembly according to the first aspect of the present invention, the sub-wavelength elements are filled with a dielectric material.

According to a further implementation of the antenna feeder assembly according to the first aspect of the present invention, neighbouring sub-wavelength elements are spaced from each other by a distance of the same order of magnitude of the at least one dimension of the sub-wavelength elements.

According to a further implementation of the antenna feeder assembly according to the first aspect of the present invention, the longitudinal dimension of the inner cavity is larger than a wavelength corresponding to the frequency of the wave in the first frequency band. The longitudinal dimension of the inner cavity may be at least five times the wavelength corresponding to the frequency of the wave in the first frequency band.

According to a further implementation of the antenna feeder assembly according to the first aspect of the present invention, the first feeder is cigar-shaped or rod-shaped, whose diameter dimension is smaller than one wavelength corresponding to the frequency of the wave in the first frequency band.

According to a further implementation of the antenna feeder assembly according to the first aspect of the present invention, the wall thickness of the dielectric radiating section is tapered along the axis of the first feeder until an open end portion of the radiating section. For example, the thickness of the wall gradually decreases towards the open end portion of the radiating section so that the thickness of the wall at the open end portion is about one percent of the wavelength corresponding to the frequency of the wave in the first frequency band.

The combination of sub-wavelength elements with said tapered wall provides additional flexibility for designing feeder with optimum broadband performance and stable phase center, at the cost of an affordable increase of manufacturing complexity.

According to a further implementation of the antenna feeder assembly according to the first aspect of the present invention, the wall of the dielectric radiating section is formed by materials with different dielectric constants.

A second aspect of the present invention provides a multi-band microwave antenna, comprising a dish reflector, a subreflector, and an antenna feeder assembly according to the aforementioned first aspect of the present invention.

BRIEF DESCRIPTION OF DRAWINGS

The present invention is explained more in detail by making reference to these drawings.

DETAILED DESCRIPTION OF EMBODIMENTS

This invention relates to a feeder assembly of a multi-band antenna and a multi-band antenna including such feeder assembly.

Multi-Band Antenna

Figure 1:
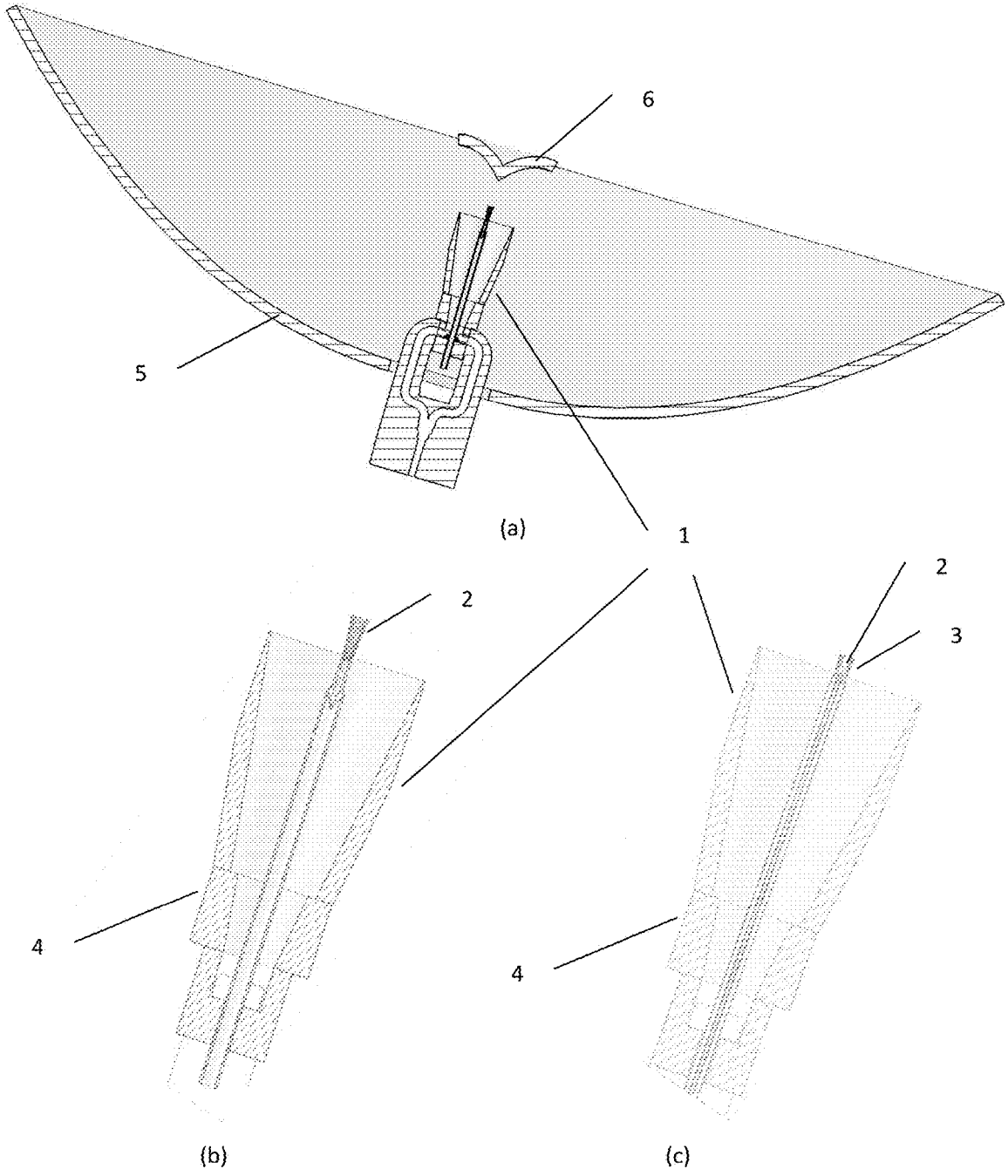
FIG. 1 shows a multi-band dish antenna.

FIG. 1 shows an embodiment of a multi-band antenna according to this invention. This multi-band antenna in FIG. 1(*a*) may be a high-gain dish antenna comprising a multi-band feeder assembly 1, a main reflector dish 5 and a subreflector 6. The multi-band feeder assembly 1 includes a first feeder 2 with a sub-wavelength element (or subwavelength structure) of at least two different dielectric constants arranged along the longitudinal direction of the first feeder. The sub-wavelength element, described in more detail below, reduces the propagation speed of waves in the multi-band antenna. Thus shifting or displacement of the phase center of the multi-band antenna is minimized and the multi-band antenna is able to have a stable phase center. A multi-band antenna with a stable phase center has the effect(s) of enabling wide band antenna operation with constant performance, e.g. in terms of antenna efficiency, peak gain and sidelobe pattern.

The multi-band feeder assembly 1 may have different architectures. The two bottom insets (b) and (c) of FIG. 1 show the axial cross-section views of two different examples of the feeder assembly 1, namely an exemplary threefold-band feeder assembly and an exemplary dual-band feeder assembly. Both of these assemblies are described in the later section.

Dual-Band Feeder Assembly

Figure 2:
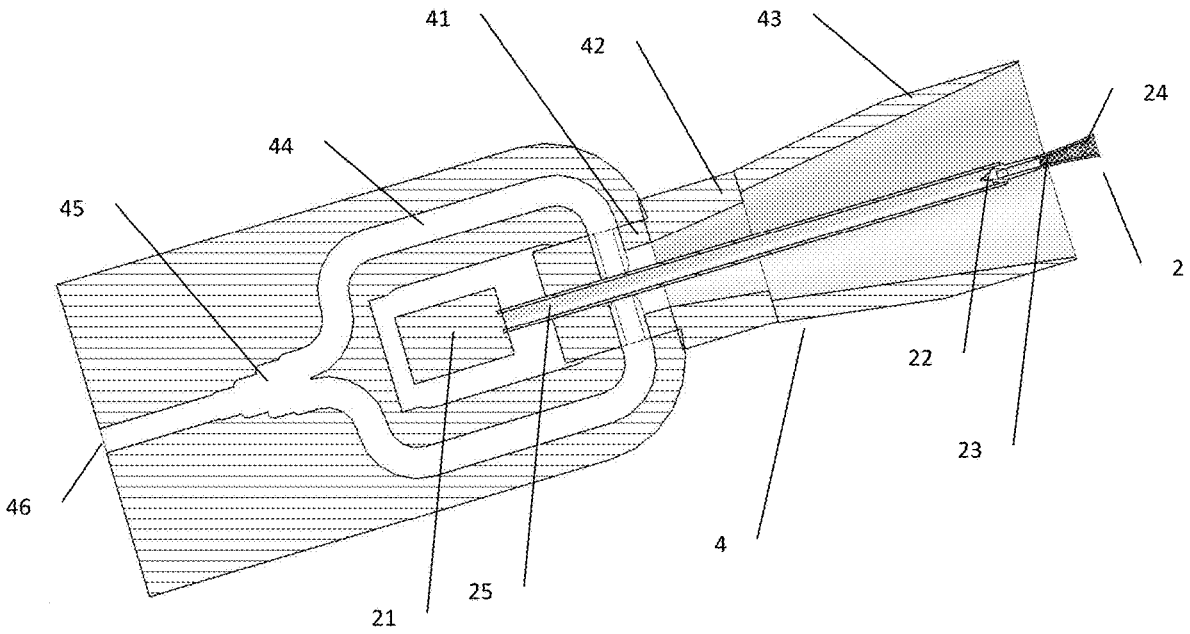
FIG. 2 shows a feeder assembly for dual-band operation.

FIG. 2 shows an example of the dual-band feeder assembly. The dual-band feeder assembly includes a first feeder 2 and a second feeder 4 coaxially surrounding the first feeder 2. The dual-band feeder assembly may be axially symmetric and the second feeder 4 may have a smooth-wall.

The first feeder 2 supports a first propagation of waves in a first frequency band. The second feeder 4 supports a second propagation of waves in a second frequency band lower than the first frequency band. For example, the first frequency band may be a millimeter band traditionally available for terrestrial wireless communications and the second frequency band may be a microwave band. Correspondingly, the first feeder 2 may work as a millimeter-wave feeder and the second feeder 4 may work as a microwave feeder. The highest frequencies of millimeter-wave bands may be devoted to Radio-Links up to terahertz frequencies, for instance covering any band of frequency devoted to radio services in the range from 71 GHz to 0.95 THz or even at higher frequencies.

The first feeder 2 includes a sub-wavelength element of at least two different dielectric constants. This sub-wavelength element reduces the speed of the propagation of waves in the first frequency band. Thus shifting or displacement of the phase center of the dual-band antenna is minimized and the multi-band antenna is able to have a stable phase center.

Example of each of the first feeder 2 and the second feeder 4 in the dual-band feeder assembly is described below.

a. The feeder 2, as shown by FIG. 2, includes an OMT (Ortho Mode Transducer) 21, a circular waveguide 25, a multi-step dielectric-to-waveguide transition 22, a dielectric emitting section 23, and a dielectric radiating section 24. Both the dielectric emitting section 23 and the radiating section 24 include an inner cavity, a wall, and sub-wavelength elements on an external surface of the wall. The circular waveguide 25 supports TE11 or HE 11 mode of propagation in the highest frequency band (e.g. millimeter band) and is surrounded by a microwave coaxial-waveguide OMT 41 of the second feeder 4. Moreover, the circular waveguide 25 is fed by the OMT 21 and is used to excite the multi-step dielectric-to-waveguide transition 22. The multi-step dielectric-to-waveguide transition 22 feeds the dielectric emitting section 23 and the dielectric radiating section 24. It can be seen that the feeder 2 can be excited either by a TE11 waveguide mode or by a low-loss HE11 hybrid waveguide mode, because both these modes of excitation allow a broadband matching.

Depending on the frequency, the waveguide 25 can be constructed from either conductive or dielectric materials. Generally, the lower the frequency to be passed the larger the waveguide is. Waveguide propagation modes depend on the operating wavelength and polarization and the shape and size of the guide. The longitudinal mode of a waveguide is a particular standing wave pattern formed by waves confined in the cavity. The transverse modes are classified into TE modes (transverse electric), TM modes (transverse magnetic), TEM modes (transverse electromagnetic) and Hybrid modes. The mode with the lowest cutoff frequency is termed the dominant mode of the guide. Hybrid modes have both electric and magnetic field components in the direction of propagation.

The guide can be chosen such that only one mode can exist in the frequency band of operation.

Optionally, the first feeder 2 may be a Dielectric Rod Feeder. This Dielectric Rod Feeder may be made of one-piece of dielectric material and suitable for broadband operation at millimeter-wave and terahertz frequencies.

The feeder 4 comprises a dual-mode conical horn that may be excited by a TE11 mode of a circular waveguide. For example, the feeder 4 includes an input port rectangular waveguide 46, a multi-step impedance transformer 45, a two-branch divider 44, a coaxial waveguide OMT 41, a coaxial waveguide dual-mode step transition 42, and a smooth-walls conical-horn radiating section 43. The input port rectangular waveguide 46 is connected to a multi-step impedance transformer 45 which excites the rectangular waveguide junction of a two-branch divider 44. These two branches of the divider 44 are connected to the coaxial waveguide OMT 41 in pipeline with the coaxial waveguide dual-mode step transition 42 and with the smooth-walls conical-horn radiating section 43 which radiates both TE11 and TM11 modes in the lower microwave frequency band of operation of the Multi-band Feeder assembly 1. However, when a very broad band operation is required in the low-frequency microwave band, a corrugated horn could replace the smooth-walls microwave feeder 4.

It can be seen that the feeder 2 in FIG. 2 does not interact with the surrounding coaxial waveguide components 41, 42, 43, 44, 45 and 46 belonging to the lower frequency microwave feeder 4. Therefore independent optimum operations with best performances of both feeders are enabled, without requiring the addition of any filter or isolator component.

Threefold-Band Feeder Assembly

Figure 3:
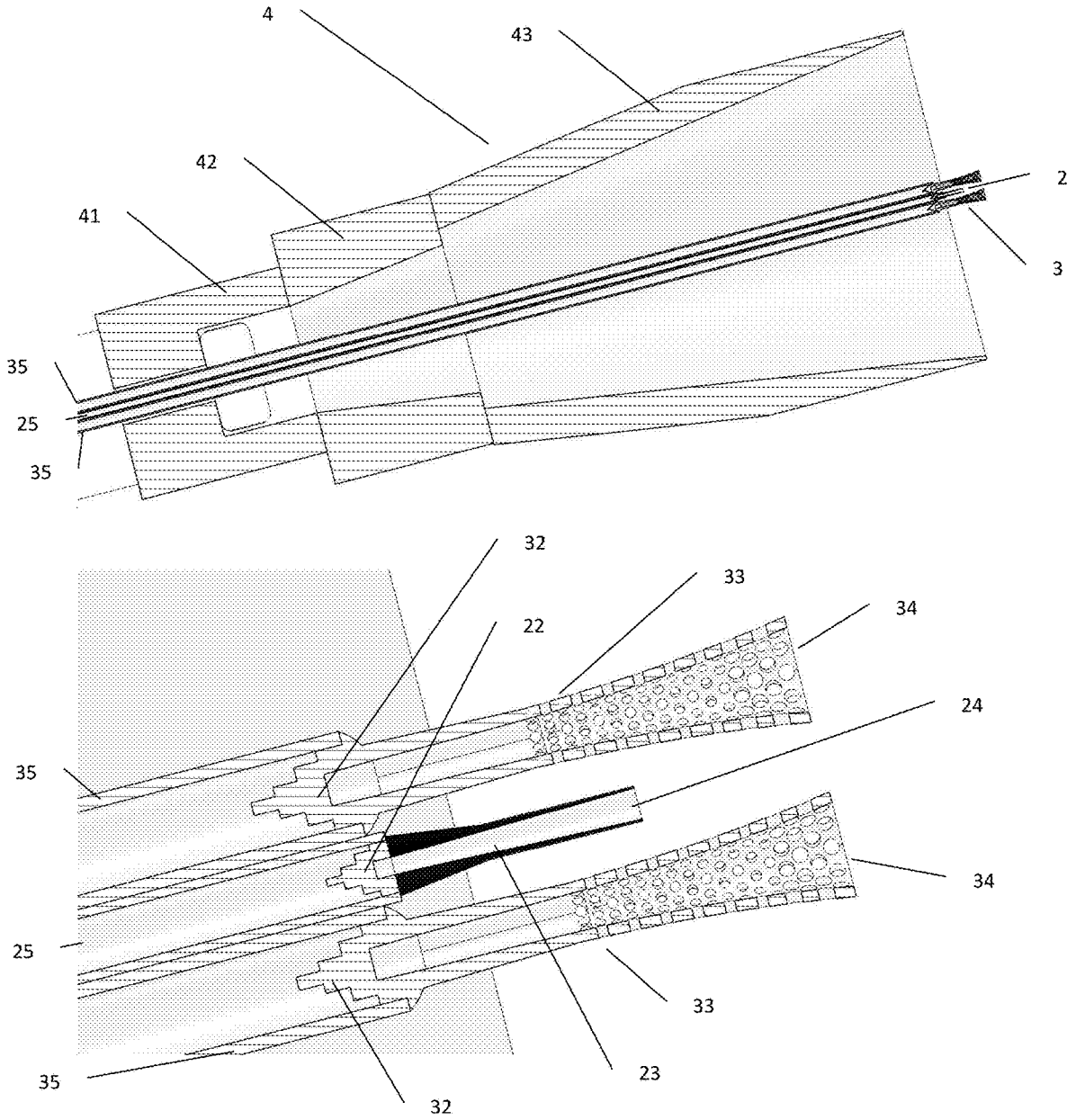
FIG. 3 shows a feeder assembly for threefold-band operation.

FIG. 3 shows an example of threefold-band feeder assembly. This threefold-band feeder assembly includes a first feeder 2, a second feeder 4, and an array of two or more third feeders 3. The second feeder 4 coaxially surrounds the first feeder 2 and the third feeders 3.

Structures of the first feeder 2 and the second feeder 4 are respectively same as the first feeder 2 and the second feeder 4 in the aforementioned dual-band feeder assembly. The size of the first feeder in this threefold-feeder assembly depends on the first and highest frequency of operation of the threefold-band feeder assembly.

a. The axially symmetric circular array of feeders 3 are regularly spaced around the high-frequency feeder 2. The structure of each of the third feeders 3 is also same as the first feeder 2 in the aforementioned dual-band feeder assembly, but the size of the third feeder 3 depends on the third frequency band of operation of the threefold-band feeder assembly.

The first feeder 2 supports a first propagation of waves in a first frequency band, the third feeder 3 supports a third propagation of waves in a third frequency band lower than the first frequency band, and the second feeder 4 supports a second propagation of waves in a second frequency band lower than the third frequency band. That is, the outermost feeder 4 works to the waves in the lowest frequency band, namely the second frequency band. For example, the second frequency band may be a microwave band traditionally available for terrestrial wireless communications, the third frequency band may be a millimeter-wave band, and the first frequency band may be a terahertz-wave band. Correspongdingly, the second feeder 4 may work as a microwave feeder, the third feeder 3 may work as a millimeter-wave feeder, and the first feeder 2 may work as a terahertz feeder. The highest frequencies of millimeter-wave bands may be devoted to radio services up to terahertz frequencies.

The first feeder 2 and/or the third feeder 3 also include a sub-wavelength element of at least two different dielectric constants. This sub-wavelength element may reduce the speed of the propagation of waves in the first frequency band and/or in the third frequency band. Thus shifting or displacement of the phase center of the dual-band antenna is minimized and the multi-band antenna is able to have a stable phase center.

Example of each of the first feeder 2, the array of two or more third feeders 3 and the second feeder 4 in the threefold-band feeder assembly are described below.

The first feeder 2, as shown by FIG. 2, includes an OMT 21, a circular waveguide 25, a multi-step dielectric-to-waveguide transition 22, a dielectric emitting section 23, and a dielectric radiating section 24. Both the dielectric emitting section 23 and the radiating section 24 include an inner cavity, a wall, and sub-wavelength elements on an external surface of the wall. The circular waveguide 25 supports TE11 mode of propagation in the highest frequency band (e.g. terahertz-wave band) and is surrounded by a microwave coaxial-waveguide OMT 41. Moreover, the circular waveguide 25 is fed by the OMT 21 and is used to excite the multi-step dielectric-to-waveguide transition 22 feeding the dielectric emitting section 23 and the dielectric radiating section 24. It can be seen that the feeder 2 here can also be excited either by a TE11 waveguide mode or by a low-loss HE11 hybrid waveguide mode, because both these modes of excitation allow a broadband matching.

Optionally, the first feeder 2 may be a Dielectric Rod Feeder. This Dielectric Rod Feeder may be made of one-piece of dielectric material and suitable for broadband operation at millimeter-wave and terahertz frequencies.

Each third feeder 3 in the array of two or more millimeter-wave feeders 3 comprises a circular waveguide 35 which excites the waveguide-to-dielectric transition 32. The waveguide-to-dielectric transition 32 is followed by the dielectric emitting section 33 and finally by the dielectric radiating section 34. Each circular waveguide 35 is fed by a relevant OMT 31, which enables dual polarization operation of the millimeter-wave feeder 3. Thus, all feeders 2 and 3 are axially symmetric for properly enabling dual polarization operation. Each of the first feeder 2 and the third feeders 3 may be Dielectric Rod. Each of the third feeders 3 is also made of one-piece of dielectric material, centered along the symmetry axis of the assembly, together with the relevant excitation waveguide 35.

The second feeder 4 here also comprises a dual-mode conical horn that may be excited by a TE11 mode of a circular waveguide. For example, the microwave feeder 4 includes an input port rectangular waveguide 46, a multi-step impedance transformer 45, a two-branch divider 44, a coaxial waveguide OMT 41, a coaxial waveguide dual-mode step transition 42, and a smooth-walls conical-horn radiating section 43. The input port rectangular waveguide 46 is connected to a multi-step impedance transformer 45 which excites the rectangular waveguide junction of a two-branch divider 44. These two branches of the divider 44 are connected to the coaxial waveguide OMT 41 in pipeline with the coaxial waveguide dual-mode step transition 42 and with the smooth-walls conical-horn radiating section 43 which radiates both TE11 and TM11 modes in the lower microwave frequency band of operation of the Multi-band Feeder assembly 1. However, when a very broad band operation is required in the low-frequency microwave band, a corrugated horn could replace the smooth-walls microwave feeder 4.

It can be seen that none of the feeders 2-3 interacts with the surrounding coaxial waveguide components 41, 42, 43, 44, 45 and 46 belonging to the lower frequency microwave feeder 4.

Sub-Wavelength Element

FIGS. 4*a*-7*b* show examples of the aforementioned sub-wavelength element. The sub-wavelength elements have at least two different dielectric constants and can be included in the dual-band feeder assembly and the threefold-band feeder assembly described above. Specifically, the sub-wavelength elements may be arranged in the first feeder 2 and/or third feeder 3 described above. The first feeder 2 is described below as an example. The description below will also apply to the third feeder 3. As mentioned above, the first feeder 2 comprises a dielectric emitting section 23 and a dielectric radiating section 24 and an inner cavity. The dielectric emitting section 23 and/or the radiating section 24 includes a wall and sub-wavelength elements on or in an external surface of the wall. The sub-wave element or structure may have different shapes. The sub-wave element may have several dimensions such as width, length, height, or diameter. At least one dimensions of the sub-wavelength element or characteristic dimension is smaller than the wavelength corresponding to the operational frequency of the first feeder. The sub-wavelength elements are arranged in a sequence and neighbouring sub-wavelength elements are spaced from each other by a distance of the same order of magnitude of the characteristic dimension of the sub-wavelength element. In an implementation, if the characteristic dimension of the sub-wavelength element is less than a quarter of a wavelength corresponding to the operating frequency of the feeder, the distance between neighbouring sub-wavelength elements will be around a quarter of said wavelength. The subwave element may have a dielectric constants different than the dielectric constant of the wall of the first feeder. This sub-wavelength element may include a hole or a thread in the external surface of the wall. The sub-wavelength element may also include a portion of the external surface formed by several layers of dielectric material with different dielectric constants. The sub-wave element may be, for example, a tooth, a groove or a pair of one tooth and one groove adjacent to each other. These elements may be arranged so as to form a corrugated external surface of the dielectric feeder or, similarly, in a threaded external surface.

Alternatively, the sub-wave elements may be portions of the wall of different dielectric constants arranged in alternating sequence along a longitudinal direction of the first feeded as described in more detail in the following.

Optionally, at least one dimension of the sub-wavelength element, or the characteristic dimension is not greater than one fourth of wavelength of the wave in the first frequency band.

The wavelength element may have a circular shape. In this case the characteristic dimension may be a diameter of the wavelength element.

Alternatively, the wavelength element may have a square or rectangular shape. The characteristic dimension of a square- or rectangular-shaped sub-wavelength element may be an edge of the square or the width or the height of the rectangle. Alternatively, the characteristic dimension may be a diagonal of the sub-wavelength element.

According to a further implementation the sub-wavelength element may be a thread (discussed below). In this case the characteristic dimension may be a width of the thread.

Clearly, other shapes may be chosen for the wavelength element, depending on the manufacturing process used and the design of the feeder, given that at least one dimension of the sub-wavelength element is smaller than the wavelength corresponding to the operational frequency of the feeder.

1. Hole or Thread

Figure 4A:
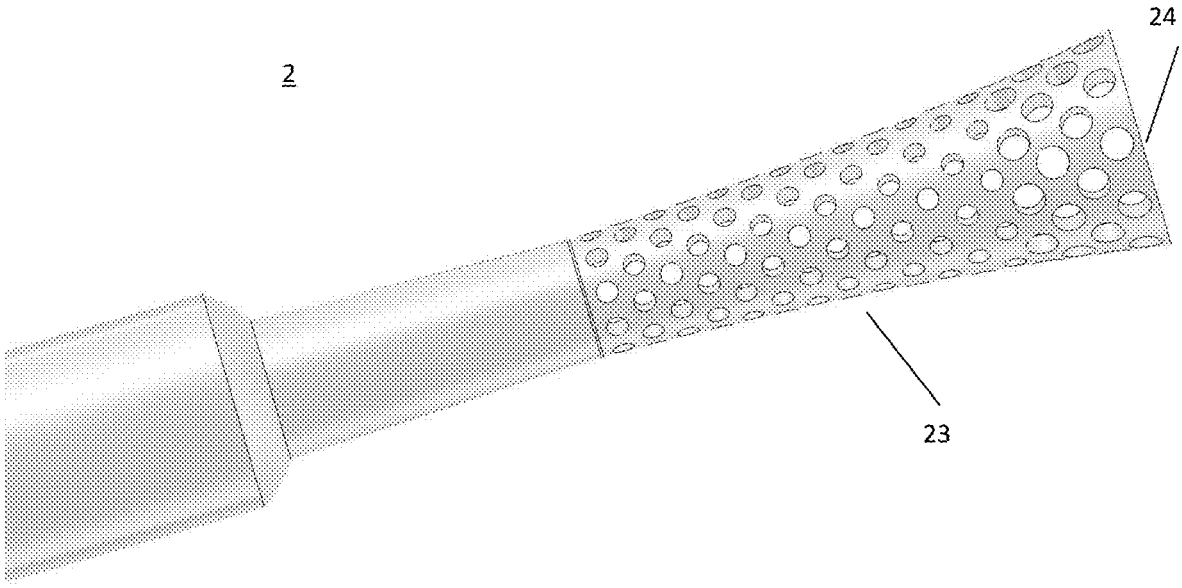
FIG. 4*a* & FIG. 4*b* show an example of a feeder including sub-wavelength elements.
Figure 4B:
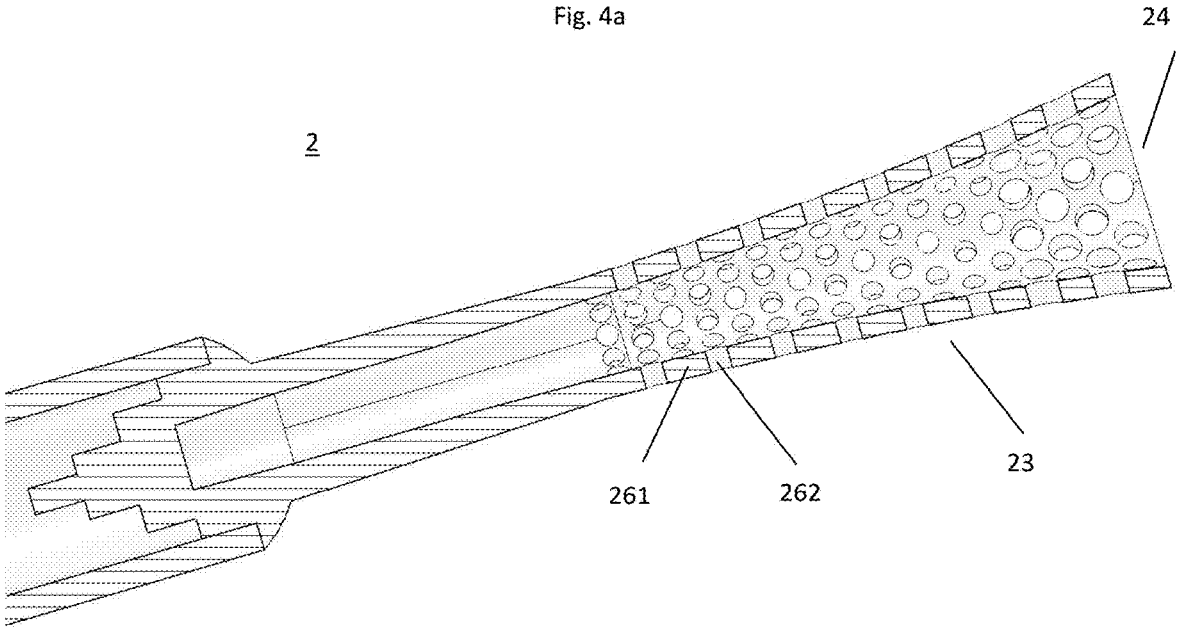

The sub-wavelength element may have different structures or shapes. For example, the sub-wavelength element may include either a hole or a thread. As can be seen in FIGS. 4*a* and 4*b*, the hole 262 may pierce the wall of the dielectric emitting section 23 and/or the radiating section 24 in the radial direction.

Figure 5A:
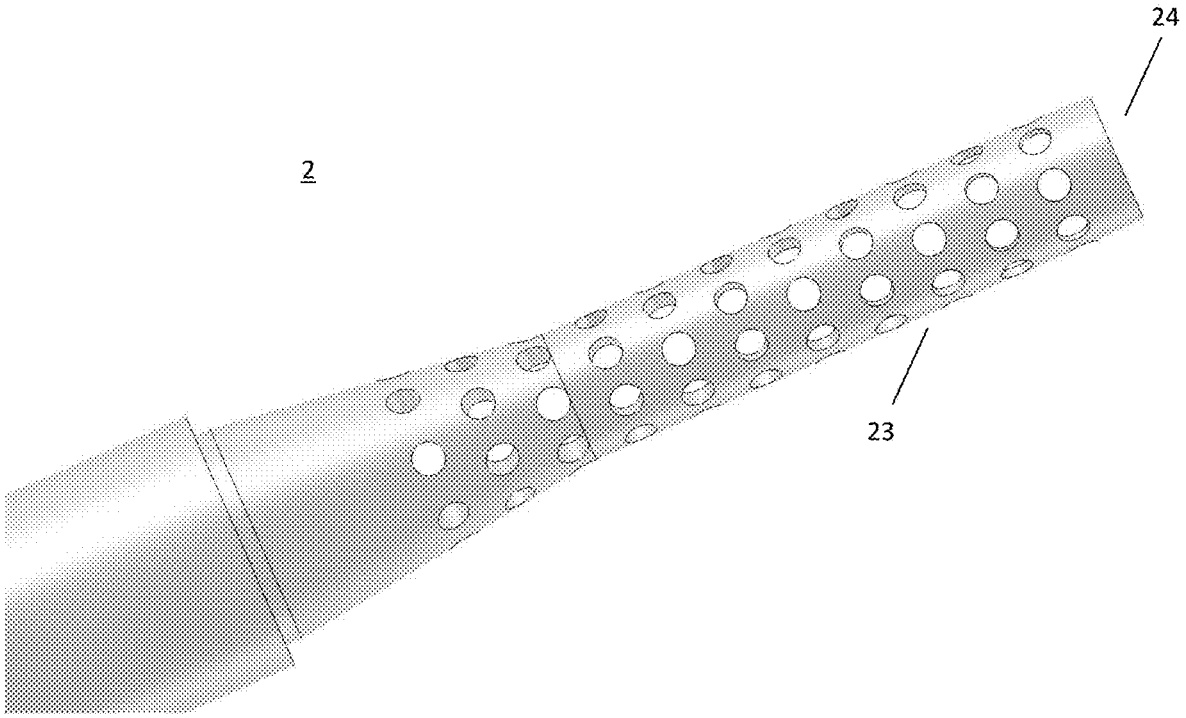
FIG. 5*a* & FIG. 5*b* show another example of a feeder including sub-wavelength elements.
Figure 5B:
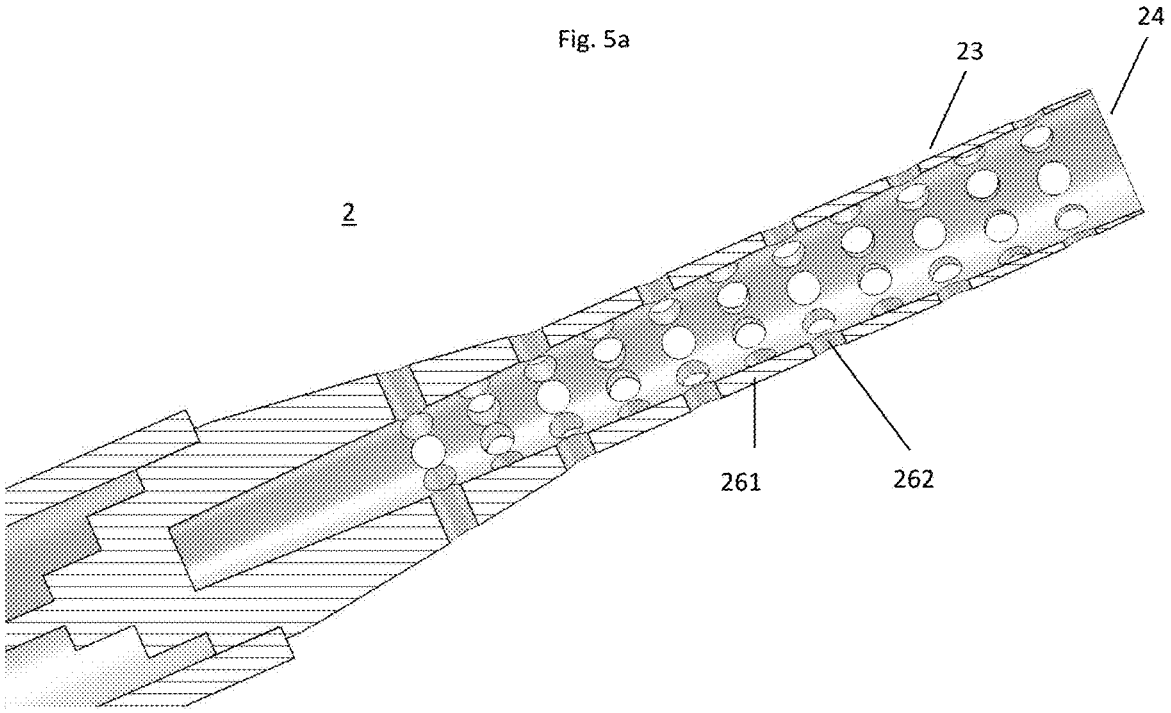

FIG. 5*a* & FIG. 5*b* show a design based on the feeder of FIG. 4*a* & FIG. 4*b*, wherein the wall of the feeder or of the emitting section 23 of the feeder is tapered towards the radiating section 24.

Figure 6A:
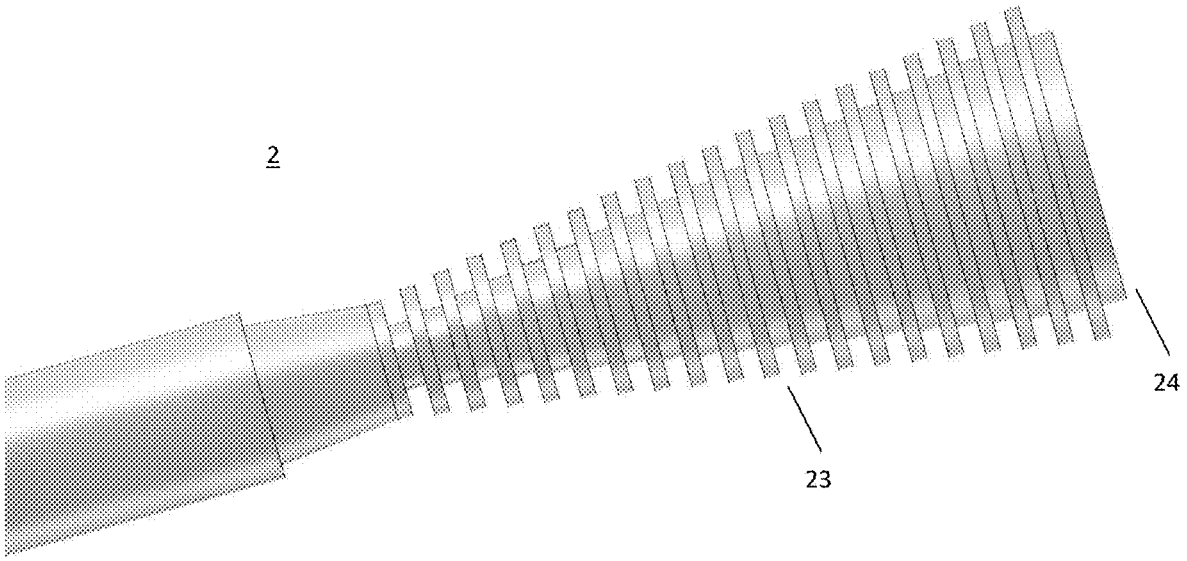
FIG. 6*a* & FIG. 6*b* show an example of a feeder including sub-wavelength elements.
Figure 6B:
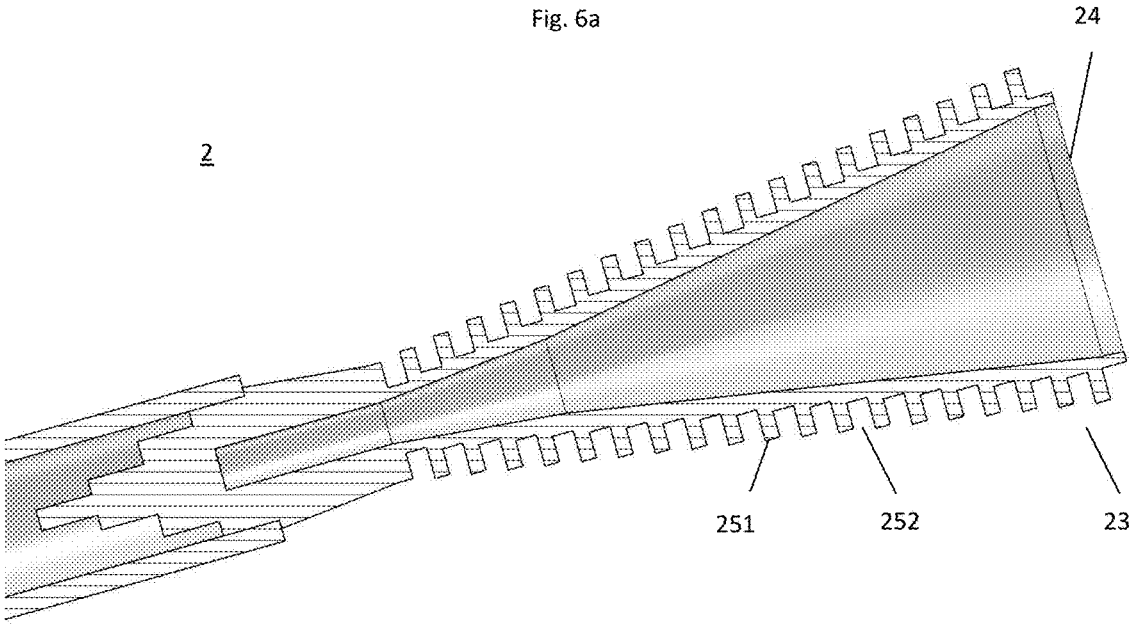
Figure 7A:
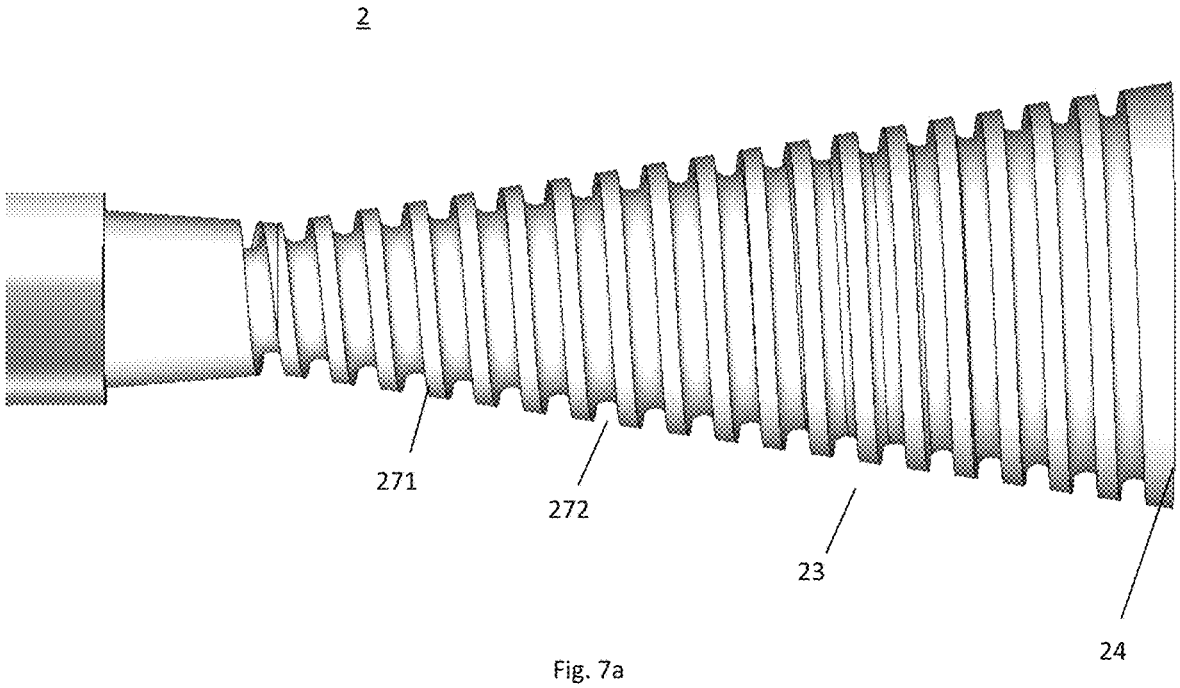
FIG. 7*a* & FIG. 7*b* show another example of a feeder including sub-wavelength elements.
Figure 7B:
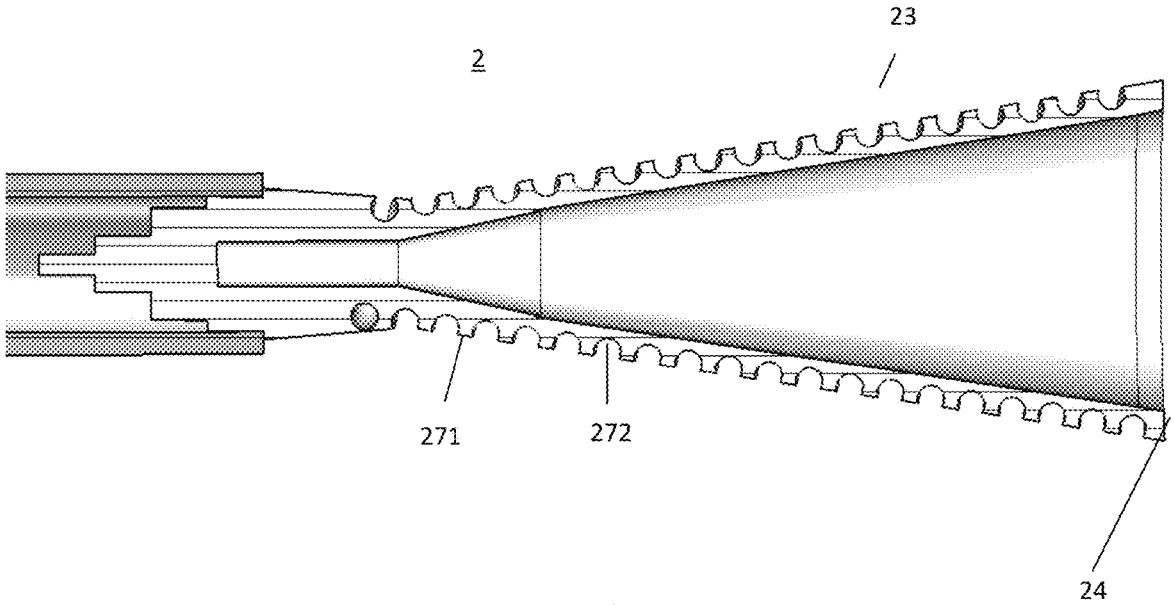

FIG. 6*a* & FIG. 6*b* show an example of a first feeder, in which the sub-wavelength elements are given by circumferential grooves 252 on the external wall of the emitting section 23 arranged in a sequence along the longitudinal direction of the feeder. In an equivalent implementation, shown in FIG. 7*a* & FIG. 7*b* the circumferential grooves may be replaced by a helicoidal thread 272 on the external wall of the emitting section 23. The threads may extend in a circumferential direction around axis of the first feeder 2. The characteristic dimension of the sub-wavelength element in this implementation is the width of the thread or groove. The threads or grooves are spaced from each other by a distance of the same order of magnitude of the at least one dimension of the sub-wavelength element.

With multiple (two or more) aforementioned holes or with the thread, the external surface is not uniform or corrugated as shown in FIGS. 4*b*, 5*b*, 6*b*, and 7*b*.

An external wall of the feeder may include teeth, each of which may also be considered as subwavelength element. The teeth may lie between at least two recesses such as the grooves 252 or holes 262. The characteristic dimension of each groove or hole is not greater than one fourth of wavelength of the wave corresponding to the operating frequency of the feeder. The dimension of each tooth is also not greater than one fourth of wavelength of the wave in the first frequency band.

By using the subwavelength element with the structure described above, nearly constant gain and shape of the "Beam" of the Feeder are obtained over its broadband of operation (as wide as 20% of relative band width). It can be seen in FIG. 8 that Gain values of this exemplary feeder equal to 18.5 dBi and are nearly constant at all frequencies (71 GHz, 76 GHz, 81 GHz, 86 GHz) which are equally spaced in a wide bandwidth, as wide as 19%. Correspondingly, at any frequency the shape of the beam remains nearly constant too.

The hole may have different forms, such as circular hole, rectangular hole, and so on. Optionally, the hole may be through-hole as well as blind-hole. FIG. 4*a* & FIG. 4*b* show a specific example of the sub-wavelength element that includes a circular through-hole piercing the wall of the dielectric emitting section 23 and/or the radiating section 24.

Optionally, the longitudinal dimension of the inner cavity is larger than a wavelength corresponding to the frequency of the wave in the first frequency band. Such longitudinal dimension of the inner cavity can increase directivity of the first feeder. The longitudinal dimension of the inner cavity may be at least five times the wavelength corresponding to the frequency of the wave in the first frequency band.

Optionally, the first feeder is cigar-shaped or rod-shaped, whose diameter dimension is smaller than one wavelength corresponding to the frequency of the wave in the first frequency band. The rod-shaped feeder is a new concept of "end-fire" Dielectric Rod radiator because it has the sub-wavelength element.

Optionally, the wall thickness of the dielectric radiating section 24 is tapered along the axis of the first feeder until an open end portion of the radiating section 24 as shown for instance in FIG. 5*a* & FIG. 5*b*. For example, the thickness of the wall gradually decreases towards the open end portion of the radiating section 24 so that the thickness of the wall at the open end portion is about one percent of the wavelength corresponding to the frequency of the wave in the first frequency band.

The wall of the first feeder 2 is continuously (i.e. without steps) tapered over several wavelengths until its open-end radiating portion. At the open end, the wall of the first feeder may be as thin as one percent of wavelength corresponding to the frequency of the wave in the first frequency band. The combination of sub-wavelength elements with said tapered wall provides additional flexibility for designing feeder 2 with optimum broadband performance and stable phase center, at the cost of an affordable increase of manufacturing complexity.

2. Material with Different Dielectric Constant

As mentioned above, the sub-wavelength element has a dielectric constant different than the dielectric constant of the dielectric emitting section 23 and/or of the dielectric radiating section 24. The dielectric constant of the sub-wavelength element may be for instance the dielectric constant of air, in case the sub-wavelength element is a hole, groove or thread. The sub-wavelength element may alternatively be a portion of the dielectric emitting section 23 and/or of the dielectric radiating section 24. In this case the dielectric constant of the sub-wavelength element may be the dielectric contant of the material of which the sub-wavelength element is formed. The sub-wavelength element may be, for instance, obtained by filling the holes or grooves or thread with a dielectric material. In a further implementation, the different layers of dielectric materials with different dielectric constant may be formed.

Therefore, the dielectric radiating section 24 and/or the emitting section 23 may be named as inhomogeneous dielectric radiating section 24 and/or emitting section 23.

According to an example, the aforementioned hole, thread or groove may be full of air that can be considered as a dielectric material. In this case the external surface of the wall is corrugated or not smooth.

According to another example, the sub-wavelength elements are filled with a dielectric material. In this case the external surface of the wall may be smooth, not corrugated. Moreover, the wall of the dielectric radiating section 24 and/or emitting section 23 may include two or more layers along the radial direction and every two neighboring layers are formed by materials with different dielectric constants. The term dielectric constant may be also called refractive index. Preferred dielectric material of the sub-wavelength element is characterized by low dielectric constant (e.g. ranging between 1 and 2.6) in order to get broadband operation of the feeder.

a. It should nevertheless be apparent that, beside the exemplary shapes here disclosed, there are numerous other forms of design and construction which are possible and still be within the scope of this invention. Further although the subwave elements were described in connection with the first feeder 2, it should be clear that any feeder and end-fire radiator in a multi-band antenna assembly may have included sub-wavelength elements as described above with reference to the first feeder 2.

Figure 8:
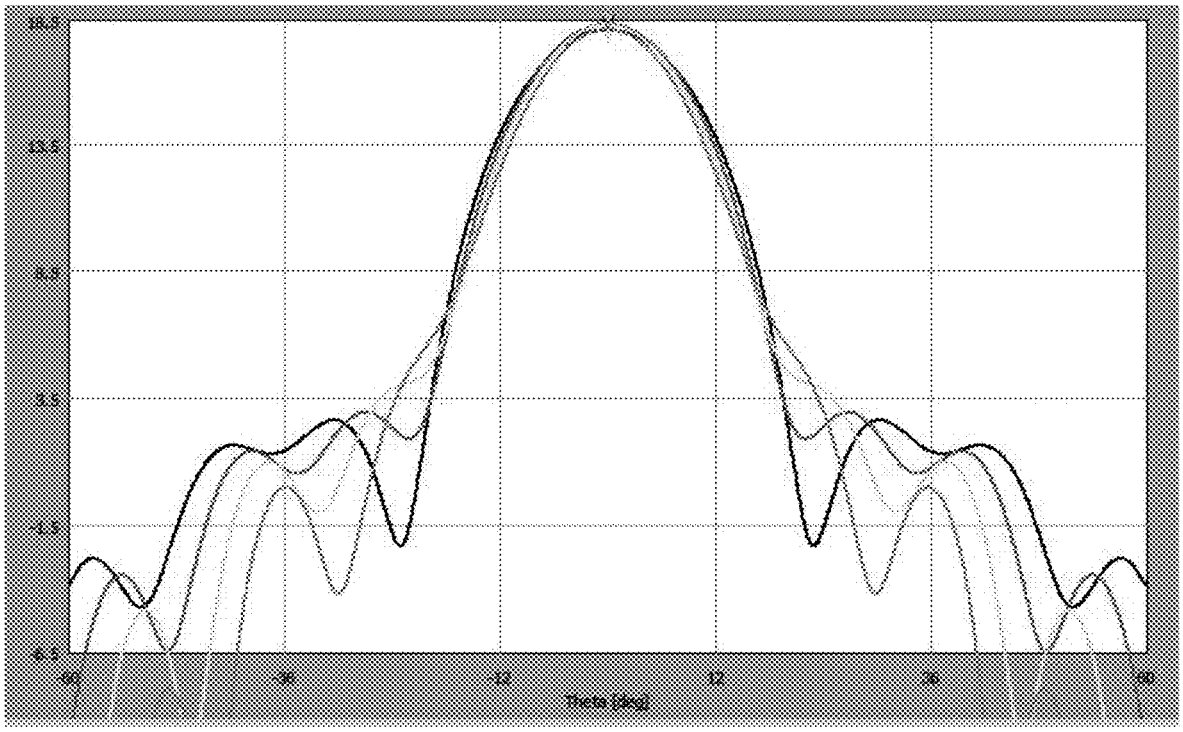
FIG. 8 shows the performance of a multiband antenna including the feeder assemblies including sub-wavelength elements as described in the present document.

FIG. 8 is a plot of the radiation pattern performance of an exemplary Feeder 1 included in the multi-band antenna assembly of the present invention. As can be seen at each frequency, falling in the full bandwidth (19%) of operation of this Feeder 1, the radiation pattern is almost constant and the peak gain is stable; thus, such characteristics of Feeder 1 facilitate the compliance of the overall multi-band antenna with the requirements of ETSI EN 302.

The invention claimed is:

1. An antenna feeder assembly of a multi-band antenna, comprising:

a first feeder supporting propagation of waves in a first frequency band; and a second feeder supporting propagation of waves in a second frequency band lower than the first frequency band, wherein:

the second feeder coaxially surrounds the first feeder;

the first feeder comprises a dielectric emitting section a dielectric radiating section, and an inner cavity; and the dielectric emitting section includes a wall and sub-wavelength elements arranged along a longitudinal direction of the first feeder on or in an external surface of the wall, wherein each sub-wavelength element of the sub-wavelength elements has a dielectric constant different than the dielectric constant of the dielectric emitting section, wherein a first sub-wavelength element of the sub-wavelength elements comprises a through-hole piercing through the wall.

2. The antenna feeder assembly according to claim 1, wherein at least one dimension of the first sub-wavelength element is not greater than one fourth of a wavelength of a wave in the first frequency band.

3. The antenna feeder assembly according to claim 2, wherein neighbouring sub-wavelength elements are spaced from each other by a distance of the same order of magnitude of the at least one dimension of the first sub-wavelength element.

4. The antenna feeder assembly according to claim 1, wherein the sub-wavelength elements are filled with a dielectric material.

5. The antenna feeder assembly according to claim 1, wherein the sub-wavelength elements include:

a hole piercing the wall in a radial direction, a thread or groove extending in a circumferential direction around an axis of the first feeder, or both.

6. The antenna feeder assembly according to claim 1, wherein a longitudinal dimension of the inner cavity is larger than a wavelength corresponding to a frequency of the wave in the first frequency band.

7. The antenna feeder assembly according to claim 6, wherein the longitudinal dimension of the inner cavity is at least five times the wavelength.

8. The antenna feeder assembly according to claim 1, wherein the first feeder is cigar-shaped or rod-shaped, whose diameter dimension is smaller than one wavelength corresponding to a frequency of a wave in the first frequency band.

9. The antenna feeder assembly according to claim 1, wherein a wall thickness of the dielectric radiating section is tapered along an axis of the first feeder until an open end portion of the dielectric radiating section.

10. The antenna feeder assembly according to claim 1, wherein a thickness of the wall gradually decreases towards an open end portion of the dielectric radiating section so that the thickness of the wall at the open end portion is about one percent of a wavelength corresponding to a frequency of a wave in the first frequency band.

11. The antenna feeder assembly according to claim 1, wherein the wall of the dielectric radiating section is formed by materials with different dielectric constants.

12. The antenna feeder assembly according to claim 1, wherein each sub-wavelength element of the sub-wavelength elements comprises a respective through-hole piercing through the wall.

13. The antenna feeder assembly according to claim 1, wherein the first sub-wavelength element has a circular shape, and wherein a diameter of the first sub-wavelength element is not greater than one fourth of a wavelength of a wave in the first frequency band.

14. A multi-band microwave antenna, comprising:
a dish reflector;
a sub reflector; and
an antenna feeder assembly of a multi-band antenna, comprising:
a first feeder supporting propagation of waves in a first frequency band; and
a second feeder supporting propagation of waves in a second frequency band lower than the first frequency band,
wherein:
the second feeder coaxially surrounds the first feeder;
the first feeder comprises a dielectric emitting section, a dielectric radiating section, and an inner cavity; and
the dielectric emitting section includes a wall and sub-wavelength elements arranged along a longitudinal direction of the first feeder on or in an external surface of the wall, wherein each sub-wavelength element of the sub-wavelength elements has a dielectric constant different than the dielectric constant of the dielectric emitting section, wherein a first sub-wavelength element of the sub-wavelength elements comprises a through-hole piercing through the wall.

15. The multi-band microwave antenna according to claim 14, wherein the first sub-wavelength element has a circular shape, and wherein a diameter of the first sub-wavelength element is not greater than one fourth of a wavelength of a wave in the first frequency band.

16. The multi-band microwave antenna according to claim 14, wherein each sub-wavelength element of the sub-wavelength elements comprises a respective through-hole piercing through the wall.

* * * * *